United States Patent [19]

Orr et al.

[11] 4,456,857

[45] Jun. 26, 1984

[54] SOCKET WITH AUTOMATIC HIGH VOLTAGE CUT-OFF

[75] Inventors: Wallace H. Orr, Saluda; Mitchell M. Osteen, Zirconia, both of N.C.

[73] Assignee: General Electric Company, Schenectady, N.Y.

[21] Appl. No.: 426,485

[22] Filed: Sep. 29, 1982

[51] Int. Cl.[3] ..... H05B 37/02

[52] U.S. Cl. ..... 315/360; 315/72; 339/110 L; 339/176 L

[58] Field of Search ..... 315/72, 360; 339/176 L, 339/110 L

[56] References Cited

U.S. PATENT DOCUMENTS

| | | | |
|---|---|---|---|
| 2,075,669 | 3/1937 | Smith et al. | 315/72 |
| 2,747,168 | 5/1956 | Arena | 339/176 |
| 3,895,195 | 7/1975 | Morrison et al. | 200/51.09 |
| 3,971,611 | 7/1976 | Rose | 339/34 |
| 4,008,414 | 2/1977 | Agnew | 315/101 |
| 4,331,905 | 5/1982 | Owen | 315/225 |

*Primary Examiner*—Harold Dixon

*Attorney, Agent, or Firm*—Ernest W. Legree; Philip L. Schlamp; Fred Jacob

[57] ABSTRACT

High voltages are removed from a safety socket when an HID lamp is unscrewed from it. The socket comprises an actuator which is engaged by the lamp base and operates a switch. When the lamp is unscrewed the switch opens the primary supply to a high voltage pulse generating circuit which is disabled thereby.

9 Claims, 7 Drawing Figures

SOCKET WITH AUTOMATIC HIGH VOLTAGE CUT-OFF

The invention relates to a safety socket from which high voltages are removed when the lamp or light bulb is unscrewed from the socket.

BACKGROUND OF THE INVENTION

The invention relates to a socket of the type adapted to receive a lamp or other load device having a threaded cylindrical shell serving as one contact, and a center contact or eyelet serving as the other contact. Lamp bases of this kind are very common, come in various sizes and are generally referred to as Edison screw bases, and the sockets therefor are available in matching sizes. For ordinary domestic sizes of incandescent lamps, the medium screw base is generally used, while for industrial applications and high intensity discharge (HID) lamps, the mogul screw base is generally used.

When an HID lamp such as a metal halide or a high pressure sodium discharge lamp is extinguished, the high vapor pressure in the arc tube prevents immediate restarting at normal voltage and a cooling interval is required. This enforced temporary outage may last from about 1 minute up to as much as 15 minutes depending upon lamp type. Circuits for quickly restarting extinguished lamps while still hot, commonly referred to as "hot restart circuits," have recently become available, one such being described in U.S. Pat. No. 4,331,905-Owen, Starting and Operating Circuit for Gaseous Discharge Lamps, issued May 25, 1982, whose disclosure is incorporated herein by reference. In hot restart luminaires utilizing such a circuit, the voltage in the lamp socket on open circuit includes pulses in the range of 5,000 to 6,000 volts at high frequencies, for instance at 20,000 hz. Such voltages are hazardous and a person replacing the lamp when power is on runs the risk of shock or burn.

SUMMARY OF THE INVENTION

The object of the invention is to eliminate the hazard presented by high voltages in a screw-type socket for HID lamps.

So-called safety or shock-proof lamp sockets for domestic use are well-known. They generally comprise tabs or shields of insulating material which block access to the contacts in a socket until forced aside by insertion of the lamp base. Such sockets may prevent finger insertion and are useful for protection of the careless or of children. But they are ineffective as protection against voltages of the present magnitude.

Circuit interrupting sockets are also known for use with fluorescent lamps, particularly instant-start fluorescent lamps which require relatively high starting voltages. Such lamps comprise long glass tubes which are provided with a pair of short-circuited pins at each end. The interrupting feature is achieved by completing the ballast primary circuit through the lamp holder terminals and a pair of short-circuited pins in the lamp base. This arrangement does not lend itself to use with the screw-type bases of HID lamps and their sockets.

Our invention overcomes the problem of high voltage hazard in screw sockets by an automatically operated switch which disables the source of high voltage. An actuator is incorporated into the socket and is arranged to operate the switch contacts. When there is no lamp in the socket, the switch is open and the high voltage source is disabled so that the socket is hazard-free. As a lamp is screwed into the socket, the actuator is engaged by the lamp base and causes the switch contacts to close. This activates the high voltage source and energizes the socket for normal lamp operation.

DETAILED DESCRIPTION

Figure 1B:
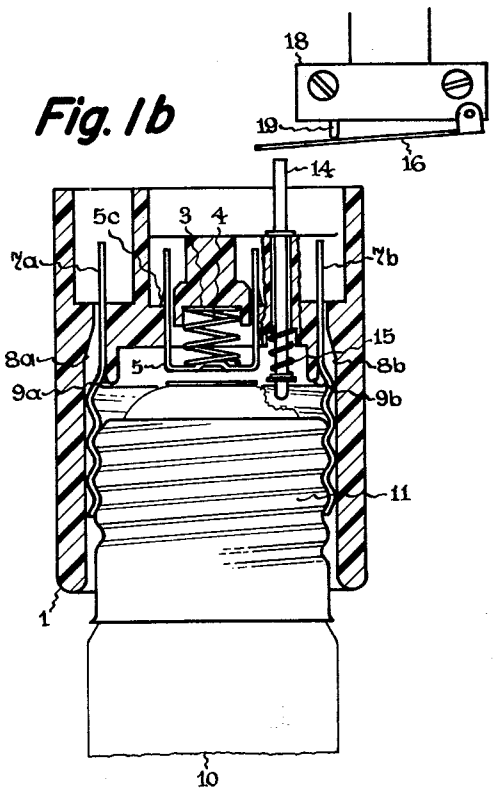
FIGS. 1*a* and 1*b* are closed and open cross section views in elevation of a socket and plunger-actuated switch combination embodying the invention together with the base portion of a lamp and with a suitable circuit schematically represented.
Figure 1A:
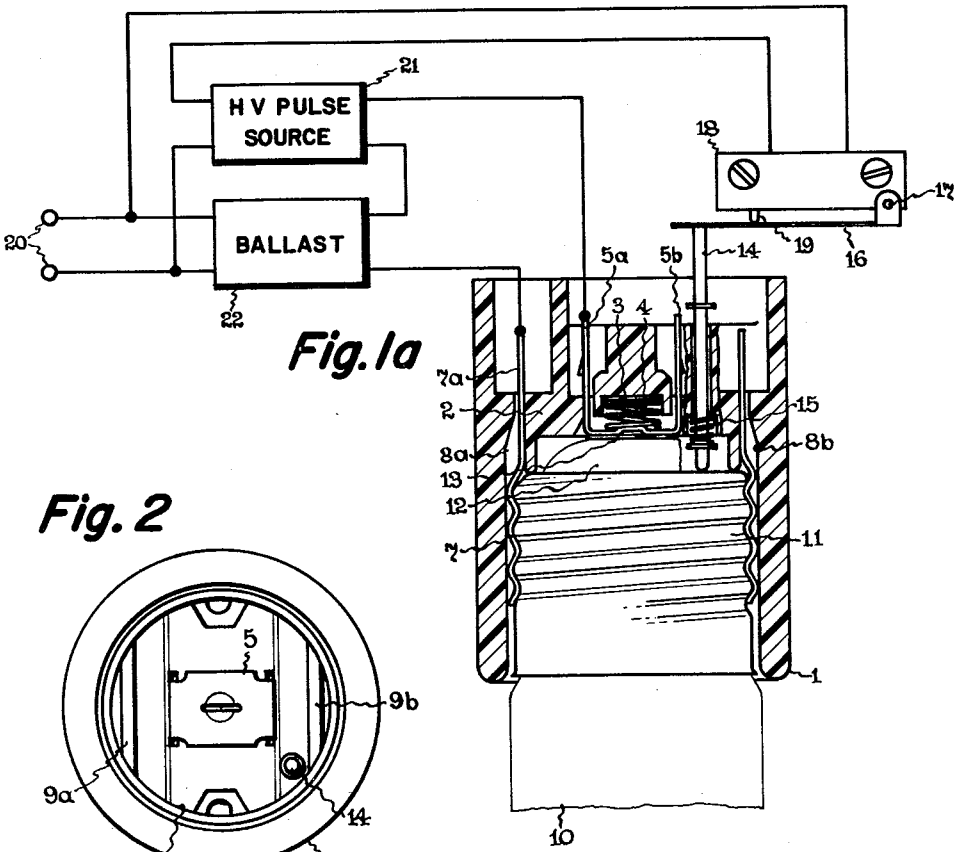
Figure 2:
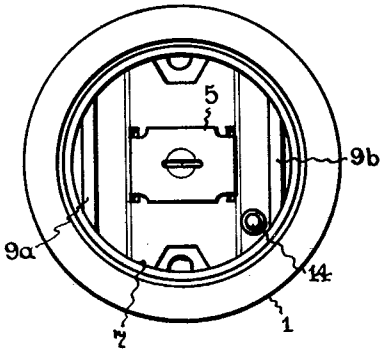
FIG. 2 is a plan view looking up into the socket of FIG. 1 when the lamp is removed.

Referring now to the drawing and more particularly to FIGS. 1 and 2, there is shown an embodiment of the invention which comprises a cylindrical socket housing 1 of electrically insulating material such as porcelain or a thermoset plastic. The housing is open at its bottom end and comprises a transverse base portion 2 near its top end. In its central region, base portion 2 is formed with a recessed generally circular seat and recess 3 for receiving coil spring 4. On opposite sides of recess 3, base portion 2 has a pair of slots for receiving the legs 5*a*, 5*b* of a U-shaped conductive contact member 5 which has a web portion underlying coil spring 4. Barbs or punched-out projections 5*c* in the legs engage the topside of base portion 2 for holding contact member 5 in assembly in the socket housing with spring 4 pressing resiliently against the web portion. The legs 5*a*, 5*b* have elongated terminal portions or tabs at their ends which project above the top of the slots for receiving push-on terminal connectors of known type (not shown).

Fitting within socket housing 1 is conductive cylindrical screw-threaded metal shell 7 having terminal strips 7*a*, 7*b* projecting upwardly from opposite sides. The arrangement is such that when the terminal strips are inserted through corresponding slots 8*a*, 8*b* in base portion 2, the ends of the strips may be twisted slightly to engage the topside of base portion 2 and lock the shell in place within the socket housing. On its under surface, base portion 2 is formed with parallel co-planar ledges 9*a*, 9*b* located inwardly of slots 8*a*, 8*b*. As seen in FIG. 1 showing part of an HID lamp 10 of conventional type mounted in socket housing 1 with its mogul thread base 11 screwed into shell 7, ledges 9*a*, 9*b* are so spaced as to engage the shoulder of the lamp base outwardly of the raised glass web 12 supporting eyelet 13. The ledges thereby serve as stop means for automatically aligning lamp 10 in the proper position along the central axis of the socket and thus provide consistent location of the light center relative to the optical elements of the luminaire. Central contact member 5, being resiliently mounted in engagement with coil spring 4, serves in effect as a "floating" contact which is readily movable in all directions and accommodates automatically to the movement of lamp 10 without tendency to tilt or cock the lamp at an angle to the socket axis. For further details on the socket, reference may be made to U.S. Pat. No. 3,890,027-Orr et al., Electrical Socket, issued June 17, 1975 whose disclosure is incorporated herein by reference.

In accordance with the present invention, means are provided for automatically removing high voltages from the socket, usually from the central contact member 5, whenever there is no lamp screwed into the socket. For this purpose there is provided in the illustrated embodiment an actuator in the form of a plunger 14 movable through a vertical passageway in base portion 2 of the socket. The plunger is biased downwardly by a coiled spring 15. The passageway is located such that the lower end of the plunger is engaged by the flat shoulder of the lamp base. The upper end of the plunger engages a blade 16 hinged at 17 on a switch 18, the blade being arranged to actuate the operating pin 19 of the switch when bent up. If desired, a conventional microswitch may be used for switch 18 and plunger 14 may be arranged to press directly on the operating pin 19 of the switch at its upper limit of travel.

Switch 18 plays the role of a disabling switch connected in the primary side of the high voltage pulse source. It is normally open as shown in FIG. 1*b*. It is closed by upward movement of plunger 14 when a lamp is screwed fully home into the socket as shown in FIG. 1*a*. As illustrated schematically in FIG. 1*a*, the switch may be connected to interrupt the primary side of the supply from the line terminals 20 to the high voltage pulse source or generator 21. In the illustrated arrangement, the pulse source provides its kilovolt pulses in series with the secondary side output of ballast 22 to central contact member 5. Since the pulse generator is a low wattage device, this arrangement has the advantage of requiring only a relatively low current microswitch to remove the hazardous kilovolt pulses from the socket. However the secondary side open-circuit output voltage of ballast 22 continues to be applied to the socket.

Figure 3B:
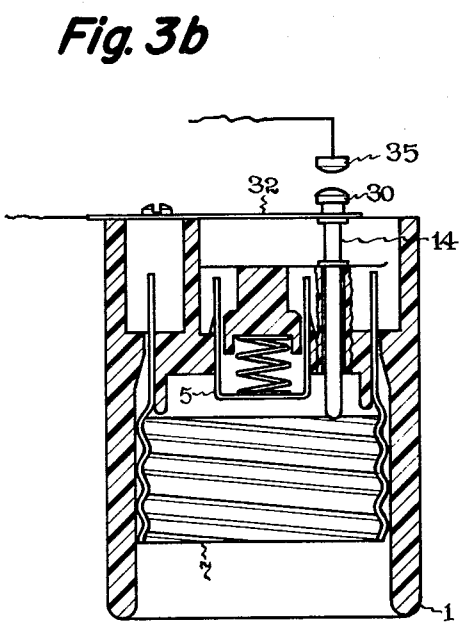
FIGS. 3*a* and 3*b* are closed and open cross section views in elevation of an integral socket switch variant.
Figure 3A:
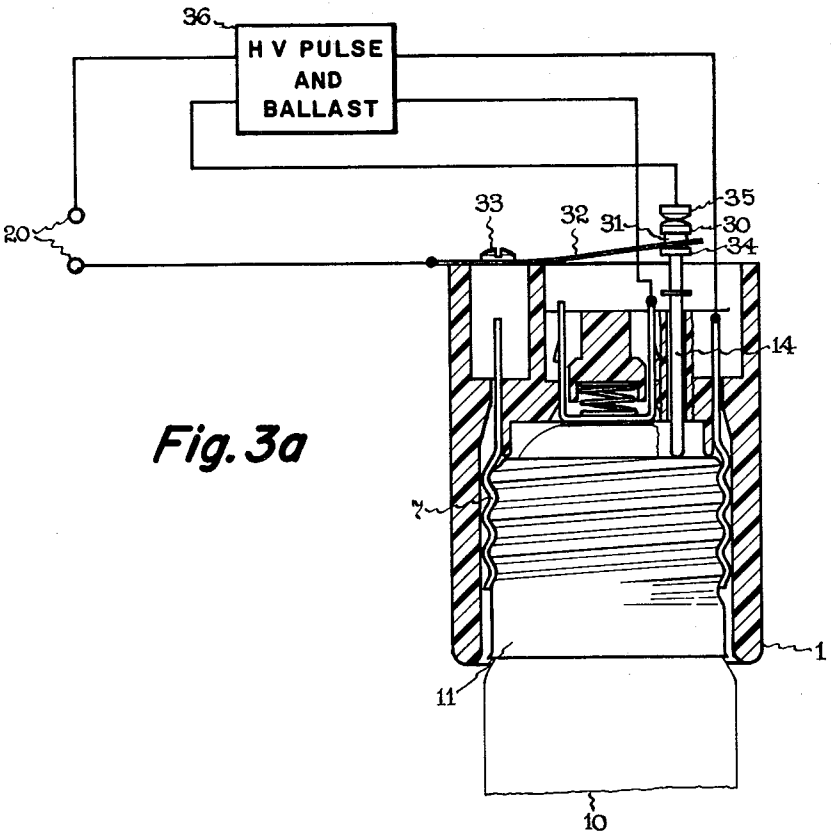

For greater safety it may be desirable to remove all voltages from the socket whenever the lamp is removed. Also there are circuits, as disclosed in the previously mentioned Owen patent, in which the pulse generating circuit is integral with the ballast. In such case the disabling switch is inserted in the primary side of the ballast to interrupt the supply thereto from the line terminals, and a switch of adequate current capacity to bear the entire ballast primary current load is used, as illustrated in FIGS. 3*a* and 3*b*. In this variant, the switch is an integral part of the socket assembly. Plunger 14 in this embodiment is made of a non-conducting material able to stand the operating temperature of the socket, suitable a ceramic material. A contact 30 topping a metal sleeve 31 is mounted on the upper end of plunger 14. A conductive spring blade 32, suitably of phosphor-bronze, is anchored at 33 to the socket housing and has a forked end which encompasses sleeve 31 and engages collar 34 in its lower end. Blade 32 presses plunger 14 down, as shown in FIG. 3*b*, and causes contact 30 to separate itself from fixed contact 35. This opens the primary circuit to the combined ballast and high voltage pulse generator 36, thereby removing all voltage from the lamp side of the socket. Screwing lamp 10 home into the socket forces plunger 14 up and moves contact 30 into engagement with contact 35 thereby restoring power.

Figure 4B:
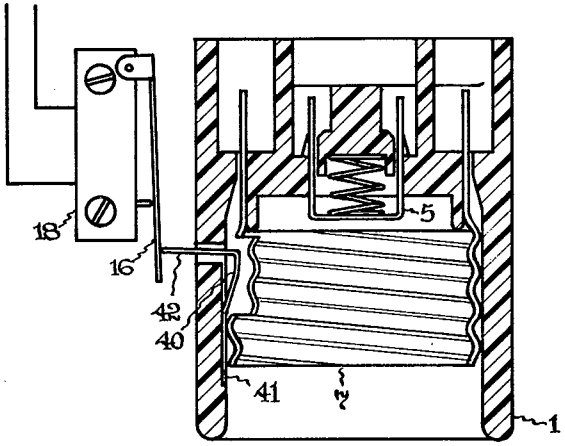
FIGS. 4*a* and 4*b* are closed and open cross section views in elevation of another socket switch variant having a side actuator.
Figure 4A:
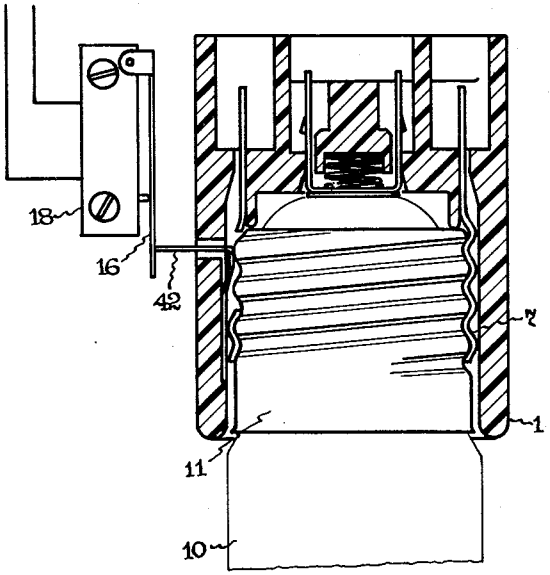

In the variant of the invention illustrated in FIGS. 4*a* and 4*b*, microswitch 18 is located on the side of socket 1. Blade 16 of the switch is moved by an actuator in the form of a spring blade 40 having a fixed end 41 wedged in a relief in the wall of the socket housing near the lower end of screw shell 7. The upper end of actuator 40 normally inclines inwardly and penetrates into the hollow socket space through a slot in screw shell 7 as shown in FIG. 4*b*. When a lamp 10 is screwed home into the socket, actuator 40 is forced laterally out by the lamp base as shown in FIG. 4*a*. This moves the laterally projecting end 42 of the actuator out through an aperture in the wall of the housing, causing switch 18 to close the primary circuit to the high voltage generator.

While the present invention has been described with reference to particular embodiments utilizing a preferred high quality socket design, it will be understood that it is equally applicable to other screw socket designs and that numerous modifications may be made by those skilled in the art without departing from the scope of the invention. The appended claims are intended to cover all such equivalent variations as come within the true spirit and scope of the invention.

What we claim as new and desire to secure by Letters Patent of the United States is:

1. A socket for accommodating a high intensity discharge lamp of the type having a screw base including an eyelet serving as a terminal, comprising:

a generally cylindrical housing of electrically insulating material closed at one end and open at its bottom end, a screw-threaded metal shell fastened within said housing and adapted to have the base of a lamp screwed up into it, a center contact in the closed end of said housing for engaging the eyelet of said lamp base, a movable actuator extending from within said metal shell through an opening in said housing, said actuator being engaged and moved by the base of said lamp when said lamp is screwed home into the socket, and a normally open switch for disabling the primary of a circuit providing high voltage to said socket, said switch being arranged to be closed by said actuator near its limit of movement.

2. A socket as in claim 1 wherein said housing includes a transverse base portion near its top end and said actuator is a vertically movable plunger extending through a passageway in said base portion, said plunger being engaged by the base of said lamp.

3. A socket as in claim 2 for accommodating a lamp having a base wherein the eyelet is supported on a web rising from a shoulder wherein said plunger is located to be engaged by the shoulder of the lamp base and forced out as a lamp is screwed up into the socket.

4. A socket as in claim 2 wherein said plunger is made of an insulating material and carries a switch contact which engages another contact at the plunger's limit of movement.

5. A socket as in claim 1 wherein said actuator comprises a spring blade penetrating into the socket space and arranged to be forced out by the base of a lamp screwed home into the socket.

6. A safety socket and circuit combination for operating a high intensity discharge lamp of the type having a screw base including an eyelet serving as a terminal, comprising:

a generally cylindrical housing of electrically insulating material closed at one end and open at its bottom end, a screw-threaded metal shell fastened within said housing and adapted to have the base of a lamp screwed up into it, a center contact in the closed end of said housing for engaging the eyelet of said lamp base, a movable actuator extending from within said metal shell through an opening in said housing, said actuator being engaged and moved by the base of said lamp when it is screwed home into the socket, a normally open switch arranged to be closed by said actuator near its limit of movement, and a high voltage generating circuit comprising a primary side and a secondary side, said switch being connected in said primary side to interrupt the line supply except when a lamp is screwed home into the socket, and said secondary side being connected to the shell and center contact of the socket.

7. A safety socket combination as in claim 6 wherein said actuator is a vertically movable plunger extending through a passageway in said housing and is located to be engaged by the base of a lamp as it is screwed home into the socket.

8. A safety socket combination as in claim 6, wherein said actuator comprises a spring blade penetrating into the socket space and arranged to be forced out by the base of a lamp screwed home into the socket.

9. A safety socket combination as in claim 6 wherein said lamp is operated by a ballast having a primary side and a secondary side connected to said center contact and supplying kilovolt pulses thereto, said switch being connected in said primary side to interrupt the line supply to said ballast when a lamp is unscrewed from the socket.

* * * * *